United States Patent [19]

Bijwaard et al.

[11] 4,385,984

[45] May 31, 1983

[54] LUBRICATING BASE OIL COMPOSITIONS

[75] Inventors: Henricus M. J. Bijwaard; Alphonsus Morcus, both of Amsterdam, Netherlands

[73] Assignee: Shell Oil Company, Houston, Tex.

[21] Appl. No.: 281,802

[22] Filed: Jul. 9, 1981

[30] Foreign Application Priority Data

Sep. 9, 1980 [NL] Netherlands ..... 8005071

[51] Int. Cl.[3] ..... E10G 45/00

[52] U.S. Cl. ..... 208/19; 208/211

[58] Field of Search ..... 208/19, 209, 211

[56] References Cited

U.S. PATENT DOCUMENTS 3,902,991 9/1975 Christensen et al. ..... 208/211
3,904,507 1/1974 Mills ..... 208/19 X

FOREIGN PATENT DOCUMENTS 1237291 6/1971 United Kingdom .
1390953 4/1972 United Kingdom .
2024852 1/1980 United Kingdom .

*Primary Examiner*—Delbert E. Gantz
*Assistant Examiner*—Glenn A. Caldarola

[57] ABSTRACT

Lubricating base oil compositions having improved stability comprise a major amount of a base oil which has been prepared from a vacuum distillate (VD) or deasphalted oil (DAO) by severe hydrotreating optionally in combination with solvent refining, and a minor amount of an oil which has been prepared from a VD or DAO by a combination of mild hydrotreating and solvent refining.

6 Claims, No Drawings

LUBRICATING BASE OIL COMPOSITIONS

BACKGROUND OF THE INVENTION

1. Field of the Invention

The invention relates to lubricating base oil compositions with improved stability.

2. Description of the Prior Art

To be suitable for use as lubricating base oil, an oil should have, in addition to a certain minimum viscosity, a certain minimum viscosity index. Fractions from crude mineral oil having a sufficiently high viscosity for use as lubricating base oil, such as vacuum distillates and deasphalted vacuum residues, have, as a rule, a very low viscosity index, which is caused by the presence in these oils of a considerable amount of polyaromatic. A significant reduction of the polyaromatics content of the oils gives oils with a sufficiently high viscosity index to make them suitable for use as lubricating base oil. The desired reduction of the polyaromatics content may, in principle, be carried out in two different ways. The oil may be extracted with a selective solvent for polyaromatics, which produces a raffinate with the desired high viscosity index. Or the oil may be subjected to a catalytic hydrotreatment under such conditions that, among other things, polyaromatics are converted into compounds with a high viscosity index. The two treatments may also be combined. The starting material may first be subjected to a solvent extraction and the raffinate obtained may subsequently be subjected to a catalytic hydrotreatment. It is also possible to subject the starting material to a catalytic hydrotreatment first and then to subject the hydrotreated product to solvent extraction.

Processes for the preparation of lubricating base oils, in with polyaromatics are converted into valuable lubricating oil components by a catalytic hydrotreatment are preferred to processes in which the polyaromatics are removed from the oils by solvent extraction, since the former processes give a higher yield of lubricating base oils and the increase in the viscosity index is greater. These advantages also apply to the processes in which a combination of catalytic hydrotreatment and solvent extraction is used to reduce the polyaromatics content, the advantage being greater, of course, as a greater part of the polyaromatics is converted by means of a catalytic hydrotreatment. A drawback of the preparation of lubricating base oils from vacuum distillates and deasphalted vacuum residues by means of a catalytic hydrotreatment is that the catalytic hydrotreatment often has an unfavorable influence on the oxidation stability of the lubricating base oil prepared. This is connected with the removal of sulfur compounds from the oil occurring simultaneously with the conversion of the polyaromatics. As the catalytic hydrotreatment is carried out under more severe conditions in order to convert a greater part of the polyaromatics into valuable lubricating oil components, a lubricating base oil is obtained with a lower oxidation stability. As a rule, if the catalytic hydrotreatment is carried out under such conditions that it results in a reduction of the sulfur content of the oil of more than 90% (further designated as "severe catalytic hydrotreatment"), a lubricating base oil is obtained with an unacceptably low oxidation stability for practical use. This rule holds both for the preparation of lubricating base oils exclusively by a severe catalytic hydrotreatment and for the preparation of lubricating base oils by a combination of a severe catalytic hydrotreatment and a solvent extraction. The reduction of the sulfur content, as referred to herein, denotes:

$$\frac{\%\ w\ S\ \text{in feed} - \%\ w\ S\ \text{in product}}{\%\ w\ S\ \text{in the feed}} \times 100\%$$

where the %w S in product relates to the sulfur content of the hydrotreated product after components boiling below the initial boiling point of the feed have been boiled off. U.K. Patent Application No. 2,024,852 deals with the improvement of the oxidation stability of lubricating base oils prepared from vacuum distillate or deasphalted vacuum residue, using a severe catalytic hydrotreatment, which severe catalytic hydrotreatment was optionally carried out in combination with solvent extraction. In the '852 patent a small amount of a mildly hydrotreated deasphalted oil, a solvent refined vacuum distillate or a solvent refined deasphalted oil is added to lubricating base oils to improve oxidation stability. Severe catalytic hydrotreatment signifies a process in which a sulfur content reduction of more than 90% takes place, while a mild catalytic hydrotreatment is defined as a treatment in which a sulfur content reduction of less than 75% takes place. Although a considerable increase of the oxidation stability of the lubricating base oils can be obtained when the above-mentioned oils are used as additives, there remains a need for a further improvement of this property. A drawback of the application of the oils prepared either by solvent extraction or by mild catalytic hydrotreatment is that they sometimes have an adverse influence on the daylight stability of the lubricating base oil to which they are needed.

SUMMARY OF THE INVENTION

It has now been found that by using a combination of a mild hydrotreatment and a solvent extraction, oils can be prepared which give a far greater improvement of the oxidation stability when added to the above-mentioned lubricating base oils than the aforementioned oils, in the preparation of which only one of these treatments was applied. It was further found that use of these oils as additives causes a considerable increase in the daylight stability of the lubricating base oils.

The present invention therefore relates to a lubricating oil composition comprising:

(a) a lubricating oil prepared from a vacuum distillate, a deasphalted vacuum residue or a mixture thereof, by applying to it a severe catalytic hydrotreatment, which catalytic hydrotreatment has optionally been carried out in combination with a solvent extraction, and (b) 0.01 to 20 percent by weight (%w), calculated on the weight of said lubricating base oil, of an oil additive prepared from a vacuum residue or a mixture thereof, by subjecting said additive to a combination of a mild catalytic hydrotreatment and a solvent extraction.

As shown in the Examples which follow, compositions according to the invention not only have improved oxidative stability, but also possess significant improvement in daylight stability. Such a combination of property advantages was not expected.

Although the lubricating base oils and the additive oils added to the lubricating base oils may be obtained from a mixture of a vacuum distillate and a deasphalted vacuum residue, it is preferred that the compositions according to the invention be lubricating base oils and additive oils prepared from either a vacuum distillate or from a deasphalted vacuum residue. If the lubricating base oil has been prepared from a vacuum distillate, oils may be added to it which have been prepared from a vacuum distillate or from a deasphalted vacuum residue. If the lubricating base oil has been prepared from a deasphalted vacuum residue, it is preferred, with a view to the volatility of the ultimate lubricating base oil composition, to add oils which have also been prepared from a deasphalted vacuum residue.

The lubricating base oils used in the compositions according to the invention may be prepared either by means of a severe catalytic hydrotreatment, or by means of a combination of a severe catalytic hydrotreatment and a solvent extraction. If the lubricating base oils are prepared without using solvent extraction, a second catalytic hydrotreatment is often carried out (designated: hydrofinishing) after the severe catalytic hydrotreatment to improve the quality of the oil. If the lubricating base oils are prepared using a combination of a severe catalytic hydrotreatment and a solvent extraction, the sequence of these treatment steps is reversible. A solvent extraction may first be applied to the starting material, followed by a severe catalytic hydrotreatment of the raffinate, or a severe catalytic hydrotreatment may first be applied to the starting material, followed by a solvent extraction of the hydrotreated product. If the lubricating base oils are prepared using a combination of a severe catalytic hydrotreatment and a solvent extraction, the preferred sequence is the one where the starting material is first subjected to solvent extraction.

The additive oils added to the lubricating base oils are prepared using a combination of a solvent extraction and a mild catalytic hydrotreatment, the sequence of these treatment steps being reversible. In the preparation of these oils it is preferred first to apply solvent extraction to the starting material and than a mild catalytic hydrotreatment to the raffinate obtained.

If in the preparation of the lubricating base oil use is made of a combination of solvent extraction and a severe catalytic hydrotreatment, the apparatus in which the solvent extraction for the preparation of the lubricating base oil is carried out, may very suitably be used for the solvent extraction for the preparation of the additive oil as well. For instance, on the basis of this principle, lubricating base oil compositions according to the invention may be prepared by applying solvent extraction to a starting material, dividing the raffinate obtained into two-portions, applying to one portion a severe catalytic hydrotreatment and to the other portion a mild catalytic hydrotreatment and, finally, combining the two hydrotreated products. On the basis of this principle it is also possible to prepare lubricating base oil compositions according to the invention by dividing a starting material into two portions, applying to one portion a severe catalytic hydrotreatment and to the other portion a mild catalytic hydrotreatment, combining the two hydrotreated products, and, finally, applying solvent extraction to the mixture.

If in the preparation of the lubricating base oil use is made of a severe catalytic hydrotreatment followed by a hydrofinishing, in which the conditions under which the hydrofinishing is carried out are such that they are in agreement with those required for the mild catalytic hydrotreatment for the preparation of the additive oil, the apparatus in which the hydrofinishing for the preparation of the lubricating base oil is carried out, may very suitably also be used for the mild catalytic hydrotreatment for the preparation of the additive oil. On the basis of this principle it is possible, for instance, to prepare lubricating base oil compositions according to the invention by dividing a starting material into two portions, applying to one portion a severe catalytic hydrotreatment and to the other portion solvent extraction, combining the hydrotreated product and the raffinate of the solvent extraction, and, finally, applying a mild catalytic hydrotreatment to the mixture.

The lubricating base oils used in the lubricating base oil compositions according to the invention are prepared starting from a vacuum distillate or deasphalted vacuum residue by applying to these products a severe catalytic hydrotreatment, if desired in combination with a solvent extraction. In these treatments it is generally intended to achieve a reduction of the polyaromatics content of more than 75%. As used herein, the reduction of the polyaromatics (PA) content denotes:

$$\frac{\text{mmol/100 g } PA \text{ in feed} - \text{mmol/100 g } PA \text{ in end product}}{\text{mmol/100 g } PA \text{ in feed}} \times 100\%$$

where mmol/100 g PA in the end product relates to the polyaromatics content of the end product after components boiling below the initial boiling point of the feed have been distilled off ("mmol" stands for millimoles). As a rule, the severe catalytic hydrotreatment is carried out at a temperature of 340° to 400° C., a pressure of 60 to 200 bar and a space velocity of 0.1 to 2 $kg.l^{-1}.h^{-1}$. Suitable catalysts for carrying out the severe catalytic hydrotreatment are catalysts containing one or more metals with hydrogenation activity on a carrier. Examples of suitable metals are: iron, nickel, cobalt, chromium, tungsten, molybdenum, platinum and copper, in particular combinations of these metals such as nickel-molybdenum, cobalt-molybdenum and nickel-tungsten. Suitable carrier materials are: silica, alumina, zirconia and magnesia and combinations thereof such as silica-alumina. If desired, the catalysts may contain promoters such as halogen, phosphorus or boron.

The additive oils added to the lubricating base oils in the formation of the lubricating base oil compositions according to the invention are prepared from a vacuum distillate or deasphalted vacuum residue by applying to these products a combination of a mild catalytic hydrotreatment and a solvent extraction. As a rule, the mild catalytic hydrotreatment is carried out at a temperature of 200° to 340° C., a pressure of 30 to 200 bar and a space velocity of 0.1 to 2 $kg.l^{-1}.h^{-1}$. Suitable catalysts for the mild catalytic hydrotreatment are, in principle, the same catalysts as may be used in the severe catalytic hydrotreatment.

The solvent extraction process that has to be used in the preparation of the additive oils to be added to the lubricating base oils and which may optionally be used in the preparation of the lubricating base oils, is a known technique: suitable solvents are phenol, furfural, N-methyl-pyrrolidone and sulphur dioxide. In the extraction a raffinate is obtained which is poor in polyaromatics and an extract rich in polyaromatics.

In the preparation of both the lubricating base oils and the additive oils it is preferred to start from vacuum distillates and deasphalted vacuum residues originating from paraffinic crude oils. With a view to the volatility of the lubricating base oil compositions according to the invention, light components formed in the catalytic hydrotreatment of the lubricating base oils and the additive oils are removed by distillation. Any heavy paraffins present in the lubricating base oils and the additive oils may, with a view to the pour point of the lubricating base oil compositions, be removed by dewaxing. Both the distillation and the dewaxing may be applied to the lubricating base oils and the additive oils separately, or to the mixtures.

The amount of additive oil that is added to the lubricating base oil is between about 0.01 and 20%w, calculated on the weight of the lubricating base oil. It is preferred to add 0.1 to 10%w of the additive oil, calculated on the weight of the lubricating base oil.

The lubricating base oil compositions according to the invention are very suitable for use for the lubrication of internal combustion engines. They may contain one or more of the usual additives, such as agents to improve the viscosity index, anti-wear additives, detergents, high-pressure additives, corrosion-inhibiting additives, pour point reducers and other antioxidants such as secondary amines and other stabilizing agents for daylight such as chinones.

The invention will now be further illustrated by reference to the following example, which is given for the purpose of illustration only and is not meant to limit the invention to the particular reactants and conditions employed therein. The VI (viscosity index) values given in the example were all determined an oil samples the pour point of which had first been reduced to −9° C. by dewaxing.

EXAMPLE

Two lubricating base oils (I and II) and six oil additive blend components (1-6) were prepared as follows:

Base Oil I

The starting material for the preparation of this oil was a vacuum distillate with a sulfur content of 2.66%w, a polyaromatics content of 31 mmol/100 g and a VI of 57. The vacuum distillate had been obtained from a paraffinic crude oil from the Middle East. The vacuum distillate was extracted with furfural, which produced a raffinate in a yield of 70%w based on the vacuum distillate. The raffinate had a sulfur content of 1.32%w, a polyaromatics content of 3.4 mmol/100 g and a VI of 88. The raffinate was subjected to a severe catalytic hydrotreatment at a temperature of 342° C., a pressure of 105 bar, a space velocity of 1.5 $Kg.l^{-1}.h^{-1}$ and a $H_2$/oil ratio of 1200 Nl. $Kg^{-1}$ (normal liters per kilogram) and using a fluorine-containing catalyst containing the metal combination nickel-tungsten on alumina as the carrier. Light components boiling below the initial boiling point of the raffinate were removed from the hydrotreated product by distillation. The remaining oil which had been obtained in a yield of 89%, based on the raffinate, had a sulfur content of 0.004%w, a polyaromatics content of 0.34 mmol/100 g and a VI of 102. Lubricating base oil I was prepared from this oil by dewaxing to a pour point of −9° C.

Base Oil II

The starting material for the preparation of this oil was a deasphalted vacuum residue with a sulfur content of 2.70%w, a polyaromatics content of 26 mmol/100 g and a VI of 78. The deasphalted vacuum residue had been obtained from a paraffinic crude oil from the Middle East. The deasphalted vacuum residue was subjected to a severe catalytic hydrotreatment at a temperature of 376° C., a pressure of 155 bar, a space velocity of 1.0 $kg.l^{-1}.h^{-1}$ and a gas velocity of 1500 $Nl.kg^{-1}$ and using the same catalyst as used in the preparation of Base Oil I. Light components boiling below the initial boiling point of the deasphalted vacuum residue were removed from the hydrotreated product by distillation. The remaining oil which had been obtained in a yield of 73%, based on the deasphalted vacuum residue, had a sulfur content of 0.017%w, a polyaromatics content of 1.6 mmol/100 g and a VI of 98. Lubricating Base Oil II was prepared from this oil by dewaxing to a pour point of −9° C.

Additive Oil 1

This oil was prepared by dewaxing the raffinate obtained as intermediate product in the preparation of Base Oil I to a pour point of −9° C.

Additive Oil 2

This oil was prepared by subjecting the vacuum distillate used in the preparation of Base Oil I to a mild catalytic hydrotreatment at a temperature of 315° C., a pressure of 155 bar, a space velocity of 1.0 $kg.l^{-1}.h^{-1}$ and an $H_2$/ratio of 1500 $Nl.kg^{-1}$ and using the same catalyst as used in the preparation of Base Oil I. Light components boiling below the initial boiling point of the vacuum distillate were removed from the hydrotreated product by distillation. The remaining oil showed a sulfur content reduction of 45% with respect to the vacuum distillate. Additive Oil 2 was prepared from this oil by dewaxing to a pour point of −9° C.

Additive Oil 3

This oil was prepared by subjecting the raffinate obtained as the intermediate product in the preparation of Base Oil I to a mild catalytic hydrotreatment at a temperature of 270° C., a pressure of 105 bar, a space velocity of 1.0 $kg.l^{-1}.h^{-1}$ and an $H_2$/oil ratio of 1200 $Nl.kg^{-1}$ and using the same catalyst as used in the preparation of Base Oil I. Light components boiling below the initial boiling point of the raffinate were removed from the hydrotreated product by distillation. The remaining oil showed a sulfur content reduction of 40% with respect to the raffinate. Additive Oil 3 was prepared from this oil by dewaxing to a pour point of −9° C.

Additive Oil 4

This oil was prepared by extracting with furfural the deasphalted vacuum residue used in the preparation of Base Oil II, which produced a raffinate in a yield of 86%, based on the deasphalted vacuum residue. The raffinate had a sulfur content of 2.26%w, a polyaromatics content of 14 mmol/100 g and a VI of 88. Additive Oil 4 was prepared from this oil by dewaxing to a pour point of −9° C.

Additive Oil 5

This oil was prepared by subjecting the deasphalted vacuum residue used in the preparation of Base Oil II to a mild catalytic hydrotreatment at a temperature of 330° C., a pressure of 155 bar, a space velocity of 1.0 $kg.l^{-1}.h^{-1}$ and an $H_2$/oil ratio of 1500 $Nl.kg^{-1}$ and using the same catalyst as used in the preparation of Base Oil I. Light components boiling below the initial boiling point of the deasphalted vacuum residue were removed from the hydrotreated product by distillation.

The remaining oil showed a sulfur content reduction of 60% with respect to the deasphalted vacuum residue. Additive Oil 5 was prepared from this oil by dewaxing to a pour point of −9° C.

Additive Oil 6

This oil was prepared from the same raffinate that from which Additive Oil 4 had been prepared by dewaxing, by subjecting the raffinate to a mild catalytic hydrotreatment at a temperature of 320° C., a pressure of 105 bar, a space velocity of 1.0 $kg.l^{-1}.h^{-1}$ and an $H_2$/oil ratio of 1200 $Nl.kg^{-1}$ and using the same catalyst as used in the preparation of Base Oil I. Light components boiling below the initial boiling point of the raffinate were removed from the hydrotreated product by distillation. The remaining oil showed a sulfur content reduction of 50% with respect to the raffinate. Additive Oil 6 was prepared from this oil by dewaxing to a pour point of −9° C.

Seven lubricating base oil compositions (A–G) were formed by adding a small amount of one of the Additive Oils 1–6 to the lubricating Base Oils I and II. The oxidation stability and the daylight stability of the lubricating Base Oils I and II and of the lubricating base oil compositions A–G were investigated.

The oxidation stability of the oils was investigated in a test in which air is blown through the oil for 168 hours at a temperature of 160° C. and in which at the end of the test the amount of sludge obtained, the acidity and the increase in the viscosity of the oil are determined.

The daylight stability of the oils was investigated in a test in which two fluorescent tubes (Philips TL 40 W/S 7) are used for irradiating Pyrex ASTM test tubes which are normally used for solidifying point tests and which contain 30 g oil and are kept at a temperature of 35°±0.5° C.; this test determines the number of days after which sludge formation occurs.

The composition of the various oils and the results of the oxidation and daylight stability tests are listed in the table.

TABLE

| Experiment No. | Lubricating base oil or lubricating base oil composition No. | Composition of the lubricating base oil composition | Oxidation stability: sludge, % w calculated on oil | Oxidation stability: acidity, mg eq/100g | Oxidation stability: viscosity increase % | Daylight stability sludge (days) |
|---|---|---|---|---|---|---|
| 1 | I | — | 11 | 36 | 1125 | 4 |
| 2 | A | Base Oil I + 5% Additive Oil 1 | 0.4 | 3 | 19 | 2 |
| 3 | B | Base Oil I + 5% Additive Oil 2 | 0.6 | 4 | 25 | 4 |
| 4 | C | Base Oil I + 5% Additive Oil 3 | 0.2 | 3 | 15 | 6 |
| 5 | D | Base Oil I + 2% Additive Oil 4 | 0.4 | 3 | 20 | 5 |
| 6 | E | Base Oil I + 2% Additive Oil 5 | 0.5 | 4 | 22 | 6 |
| 7 | F | Base Oil I + 2% Additive Oil 6 | 0.2 | 3 | 17 | 8 |
| 8 | II | — | — | 7 | 35 | 15 |
| 9 | G | Base Oil II + 2% Additive Oil 6 | — | 2 | 9 | 15 |

Of the lubricating base oil compositions A–G listed in the table, only the lubricating base oil compositions C, F and G are compositions according to the invention. These compositions were formed by adding to a lubricating base oil a small amount of an oil prepared by a combination of a solvent extraction and a mild catalytic hydrotreatment. The compositions A, B, D, and E are outside the scope of the invention and have been included in the patent application for comparison.

Comparison of the experiments 1–4 shows that addition of the Additive Oils 1 and 2 to lubricating Base Oil I causes an improvement of the oxidation stability, which improvement is greatest when Additive Oil 1 is used. Use of Additive Oil 1 results, however, in a sharp fall in the daylight stability. Use of Additive Oil 3 (according to the invention) produces not only an increase in the oxidation stability greater than the one obtained when using Additive Oil 1, but also a sharp increase in the daylight stability.

Comparison of the experiments 1 and 5–7 shows that addition of the Additive Oils 4 and 5 to Base Oil I causes both an improvement of the oxidation stability and of the daylight stability. Additive Oil 4 gives the greatest improvement of the oxidation stability and Additive Oil 5 gives the greatest improvement of the daylight stability. Use of Additive Oil 6 (according to the invention) produces not only an increase in the oxidation stability greater than the one obtained when using Additive Oil 4, but also an increase in the daylight stability which is greater than the one obtained when using Additive Oil 5.

Comparison of the experiments 1 and 7 shows that Additive Oil 6 is very suitable for increasing the oxidation and the daylight stability of a lubricating base oil which has been prepared by applying the combination of a solvent extraction and a severe catalytic hydrotreatment to a vacuum distillate. Comparison of the experiments 8 and 9 shows that Additive Oil 6 is also suitable for increasing the oxidation stability of a lubricating base oil prepared by applying exclusivity severe catalytic hydrotreatment to a deasphalted vacuum residue.

What is claimed is:

1. Lubricating oil compositions comprising:

(a) a lubricating base oil prepared from a vacuum distillate, a deasphalted vacuum residue or a mixture thereof, by applying to it a catalytic hydrotreatment under such severe catalytic hydrotreatment conditions that a sulfur content reduction of more than 90% is reached, and (b) 0.01 to 20%w, calculated on the weight of said base oil, of an additive oil prepared from a vacuum distillate, a deasphalted vacuum residue or a mixture thereof, by applying to it a combination of a mild catalytic hydrotreatment and a solvent extraction, wherein said solvent extraction reduces the polyaromatic content of said vacuum distillate, deasphalted vacuum residue or mixture thereof, and which catalytic hydrotreatment has been carried out under such conditions that a sulfur content reduction of less than 75% is reached.

2. Lubricating oil compositions according to claim 1 wherein said base oil is prepared from a vacuum distillate or from a deasphalted vacuum residue and said additive oil is prepared from a deasphalted vacuum residue.

3. Lubricating oil compositions according to claim 1 wherein said base oil and said additive oil are prepared from a vacuum distillate.

4. Lubricating oil compositions according to claims 1, 2 or 3 wherein said base oil is prepared by first applying solvent extraction and then severe catalytic hydrotreatment to the resulting raffinate.

5. Lubricating oil compositions according to claim 1 wherein said additive oil is prepared by first applying solvent extraction and then mild catalytic hydrotreatment to the resulting raffinate.

6. Lubricating oil compositions according to claim 1 wherein the amount of said additive oil is between about 0.1 to 10%w, calculated on the weight of said base oil.

* * * * *